US008222981B1

(12) United States Patent
Zarbock et al.

(10) Patent No.: US 8,222,981 B1
(45) Date of Patent: Jul. 17, 2012

(54) ELECTRICAL SWITCHING DEVICE

(75) Inventors: Kurt Thomas Zarbock, Advance, NC (US); Matthew Len Moeller, Rock Falls, IL (US); Garland H. Ladd, Jr., Lewisville, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/008,716

(22) Filed: Jan. 18, 2011

(51) Int. Cl.
*H01H 67/02* (2006.01)
*H01H 9/00* (2006.01)

(52) U.S. Cl. ..... 335/128; 335/60; 335/78; 335/80; 335/86; 335/107; 335/121; 335/124; 335/132; 335/177; 335/179; 335/181; 335/185; 335/189

(58) Field of Classification Search ..... 335/128, 335/60, 78–86, 107, 121, 124, 132, 177–179, 335/181, 185–190, 200
See application file for complete search history.

(56) References Cited

U.S. PATENT DOCUMENTS 3,348,176 A * 10/1967 Gullett ..... 335/181
4,216,452 A * 8/1980 Arnoux et al. ..... 335/128
4,388,535 A 6/1983 Wiktor et al.
4,430,579 A 2/1984 Wiktor
4,490,701 A * 12/1984 Dietrich et al. ..... 335/78
4,529,953 A 7/1985 Myers
4,562,418 A 12/1985 Bachler
4,922,216 A * 5/1990 Dietrich ..... 335/128
5,122,770 A * 6/1992 Held ..... 335/128
5,568,108 A * 10/1996 Kirsch ..... 335/130
5,684,442 A 11/1997 Hufschmid
5,694,099 A 12/1997 Connell et al.
5,945,900 A * 8/1999 Shibata et al. ..... 335/234
6,020,801 A * 2/2000 Passow ..... 335/78
6,046,660 A 4/2000 Gruner
6,046,661 A * 4/2000 Reger et al. ..... 335/185
(Continued)

FOREIGN PATENT DOCUMENTS

DE 92 15 688 U1 1/1993
(Continued)

OTHER PUBLICATIONS

European Search Report, Mail Date Aug. 5, 2012, Application No. 12151168.7-2214.

*Primary Examiner* — Mohamad Musleh

(57) ABSTRACT

An electrical switching device includes first and second circuit assemblies. Each of the first and second circuit assemblies includes a base terminal and a moveable terminal movable between an open state and a closed state. The movable terminal is electrically connected to the base terminal in the closed state. An actuator assembly is electromechanically controlled by a motor. The actuator assembly includes a pivot member rotated by the motor that has a post extending outward from a pivot body. An actuator is moved by the pivot member and is movable between a first position and a second position. The actuator is operatively coupled to the moveable terminals of the first and second circuit assemblies. The actuator moves the movable terminals to the closed state as the actuator is moved from the first position to the second position. The actuator has a pocket with a compression spring received in the pocket. The compression spring extends between a first end and a second end. The first end engages the actuator. The second end engages the post. The compression spring provides a force on the actuator to push the movable terminals toward the base terminals.

16 Claims, 4 Drawing Sheets

U.S. PATENT DOCUMENTS

| | | | | |
|---|---|---|---|---|
| 6,292,075 | B1 | 9/2001 | Connell et al. | |
| 6,320,485 | B1 | 11/2001 | Gruner | |
| 6,563,409 | B2 | 5/2003 | Gruner | |
| 6,621,393 | B2 | 9/2003 | Comtois et al. | |
| 6,628,184 | B1 | 9/2003 | Cassagrande et al. | |
| 6,816,353 | B2 | 11/2004 | Mani et al. | |
| 7,049,932 | B2 | 5/2006 | French et al. | |
| 7,504,915 | B2 * | 3/2009 | Takayama et al. | 335/78 |
| 2009/0033446 | A1 | 2/2009 | Gruner et al. | |
| 2009/0033447 | A1 | 2/2009 | Gruner et al. | |
| 2011/0048907 | A1 * | 3/2011 | Moeller et al. | 200/17 R |

FOREIGN PATENT DOCUMENTS

| | | | |
|---|---|---|---|
| EP | 1 732 099 | A2 | 12/2006 |
| EP | 1843377 | | 10/2007 |
| EP | 1968083 | | 9/2008 |
| WO | 03049129 | | 6/2003 |
| WO | 2005106907 | | 11/2005 |
| WO | 2006024855 | | 3/2006 |
| WO | 2006035235 | | 4/2006 |
| WO | 2007012883 | | 2/2007 |

* cited by examiner

ELECTRICAL SWITCHING DEVICE

CROSS REFERENCE TO RELATED APPLICATIONS

This application relates to U.S. patent application Ser. No. 12/549,176 filed Aug. 27, 2009, the subject matter of which is herein incorporated by reference in its entirety.

BACKGROUND OF THE INVENTION

The subject matter herein relates generally to electrical switching devices that are configured to control the flow of an electrical current therethrough.

Electrical switching devices (e.g., contactors, relays) exist today for connecting or disconnecting a power supply to an electrical device or system. For example, an electrical switching device may be used in an electrical meter that monitors power usage by a home or building. Conventional electrical devices include a housing that receives a plurality of input and output terminals and a mechanism for electrically connecting the input and output terminals. Typically, one of the terminals includes a spring arm that is movable between an open position and a closed position to electrically connect the input and output terminals. In some switching devices, a solenoid actuator is operatively coupled to the spring arm to move the spring arm between the open and closed positions. When the solenoid actuator is triggered or activated, the solenoid actuator generates a predetermined magnetic field that is configured to move the spring arm to establish an electrical connection. The solenoid actuator may also be activated to generate an opposite magnetic field to move the spring arm to disconnect the input and output terminals.

However, a switching device that uses a solenoid actuator as described above is not without disadvantages. For example, to control overtravel and/or to ensure adequate contact pressure between the input and output terminals, the switching devices typically include an overtravel spring. Some systems use a separate spring that is assembled to the spring arm to control the amount of overtravel and/or contact pressure force on the spring arm. Having separate components and interconnected parts within the housing may lead to greater costs and time spent to assemble the switching devices. Other systems design the spring arm to perform the function of controlling overtravel and/or contact pressure. Spring arms designed to have the dual function of controlling overtravel and/or contact pressure as well as carrying current between the input and output terminals results in trade-offs in one or both functions, as well as increases the overall cost of the spring arm by over-designing the spring arm to satisfy one or both functions. It is difficult to balance the spring arm design to satisfy both electrical properties of the switch and spring force properties of the contact overtravel. For example, having a thicker spring arm material may be better for electrical performance but may reduce the spring flexibility of the spring arm, and vice versa.

Accordingly, there is a need for electrical switching devices that simplify and reduce the cost of overtravel spring design. There is a need for separating the electrical and spring properties of the spring arm and allow for contact force optimization for the system. There is a need for electrical switching devices that may reduce the number of components and simplify the assembling as compared to known switching devices.

BRIEF DESCRIPTION OF THE INVENTION

In one embodiment, an electrical switching device is provided having first and second circuit assemblies. Each of the first and second circuit assemblies includes a base terminal and a moveable terminal movable between an open state and a closed state. The movable terminal is electrically connected to the base terminal in the closed state. An actuator assembly is electromechanically controlled by a motor. The actuator assembly includes a pivot member rotated by the motor that has a post extending outward from a pivot body. An actuator is moved by the pivot member and is movable between a first position and a second position. The actuator is operatively coupled to the moveable terminals of the first and second circuit assemblies. The actuator moves the movable terminals to the closed state as the actuator is moved from the first position to the second position. The actuator has a pocket with a compression spring received in the pocket. The compression spring extends between a first end and a second end. The first end engages the actuator. The second end engages the post. The compression spring provides a force on the actuator to push the movable terminals toward the base terminals and/or provides desired overtravel on the contacts.

In another embodiment, an electrical switching device is provided having first and second circuit assemblies. Each of the first and second circuit assemblies includes a base terminal and a moveable terminal movable between an open state and a closed state. The movable terminal is electrically connected to the base terminal in the closed state. An actuator assembly is electromechanically controlled by a motor. The actuator assembly includes a pivot member rotated by the motor that has a post extending outward from a pivot body. An actuator is moved by the pivot member between a first position and a second position. The actuator is operatively coupled to the moveable terminals of the first and second circuit assemblies. The actuator extends along a longitudinal axis and is split along the longitudinal axis into an upper actuator and a lower actuator independently movable with respect to one another. The electrical switching device includes first and second compression springs with the first compression spring extending between the post and the upper actuator and the second compression spring extending between the post and the lower actuator. The first and second compression springs provide forces on the upper and lower actuators to push the movable terminals toward the base terminals and/or provides desired overtravel on the contacts.

In a further embodiment, an electrical switching device is provided having first and second circuit assemblies. Each of the first and second circuit assemblies includes a base terminal and a moveable terminal movable between an open state and a closed state. The movable terminal is electrically connected to the base terminal in the closed state. The moveable terminals of the first and second circuit assemblies extend substantially parallel to one another and have a spacing therebetween. An actuator assembly is electromechanically controlled by a motor received in the spacing. The actuator assembly includes a pivot member received in the spacing that is rotated by the motor. The pivot member has a post extending outward from a pivot body. An actuator extends lengthwise across the spacing and is operatively coupled to the pivot. The actuator is movable between a first position and a second position by the pivot. The actuator is operatively coupled to the moveable terminals of the first and second circuit assemblies. The actuator moves the movable terminals to the closed state as the actuator is moved from the first position to the second position. A compression spring extends between the actuator and the post. The compression spring provides a force on the actuator to push the movable terminals toward the base terminals and/or provides desired overtravel on the contacts.

DETAILED DESCRIPTION OF THE INVENTION

Figure 1:
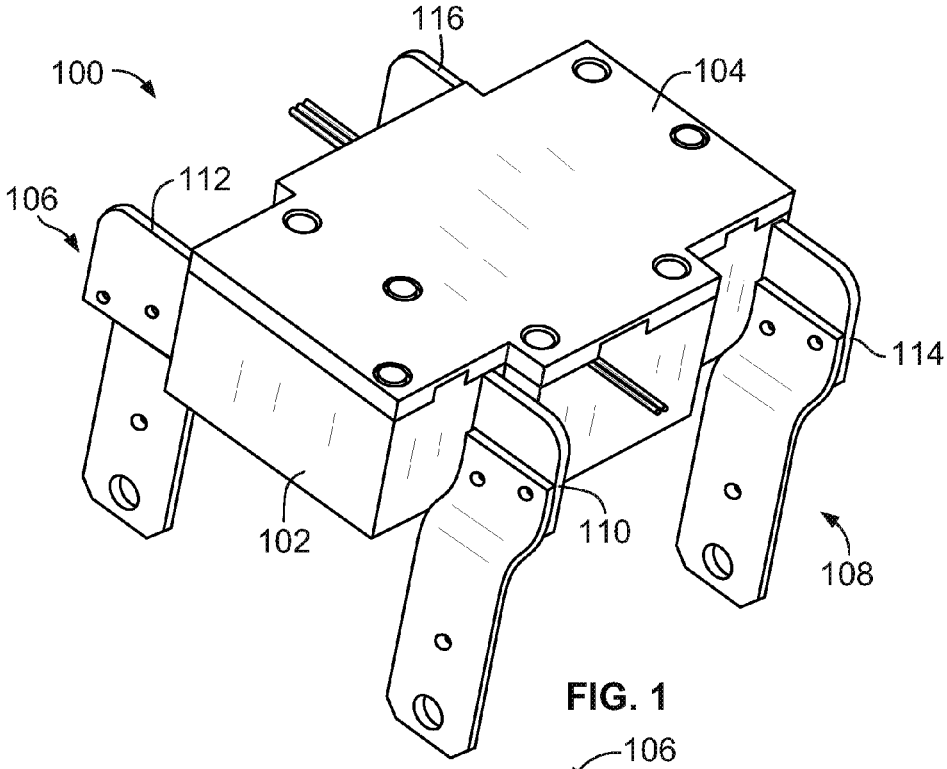
FIG. 1 is a top perspective view of an electrical switching device formed in accordance with an exemplary embodiment.

FIG. 1 is a top perspective view of an electrical switching device 100 formed in accordance with an exemplary embodiment. The switching device 100 includes a switch housing 102 and a cover 104 coupled to the switch housing 102. The switching device 100 is configured to receive and enclose at least one circuit assembly (shown as a pair of circuit assemblies 106 and 108). The circuit assemblies 106, 108 may also be referred to as poles.

The switching device 100 is configured to selectively control the flow of current through the circuit assemblies 106, 108. By way of one example, the switching device 100 may be used with an electrical meter of an electrical system for a home or building. For example, the switching device 100 is designed to be fitted within a domestic electrical utility meter casing for isolating the main utility power feed from the domestic loads in the house or building. The switching device 100 is configured to safely withstand reasonable short circuit faults on the load side of the meter.

The circuit assembly 106 includes input and output terminals 110 and 112. The circuit assembly 108 includes input and output terminals 114 and 116. The input and output terminals 110, 112 electrically connect to each other within the switch housing 102, and the terminals 114, 116 electrically connect to each other within the switch housing 102. The input terminals 110, 114 receive an electrical current $I_i$ from a remote power supply, and the output terminals 112, 116 deliver the current $I_o$ to an electrical device or system. Current enters the switch housing 102 through the input terminals 110, 114 and exits the switch housing 102 through the output terminals 112, 116. The switching device 100 may disconnect the circuit assemblies 106, 108 such that no current flows to the output terminals 112, 116.

In the illustrated embodiment, the input terminals 110, 114 are received into the switch housing 102 through a common side, and the output terminals 112, 116 are received into the switch housing 102 through a common side that is different than the side that receives the input terminals 110, 114. However, in alternative embodiments, all the terminals 110, 112, 114, 116 may enter the switch housing 102 through a common side, each of the terminals 110, 112, 114, 116 may enter through different sides, or other combinations are possible.

Figure 2:
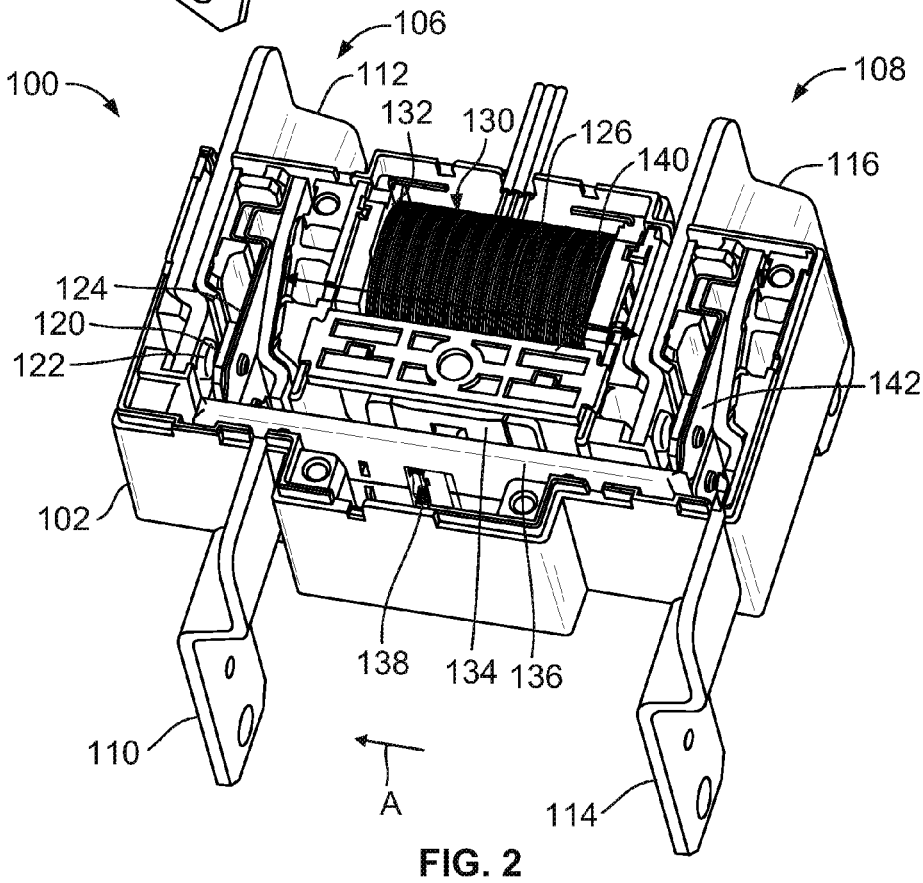
FIG. 2 is a top perspective view of the electrical switching device shown in FIG. 1, with a cover thereof removed illustrating internal components of the electrical switching device.

FIG. 2 is a top perspective view of the switching device 100 with the cover 104 removed for clarity. In order to avoid unnecessary repetition of references in the drawings, only the left-hand parts of the switching device 100 (e.g. the parts of the circuit assembly 106) will be generally referred to, it being understood that the right-hand parts of the switching device 100 (e.g. the parts of the circuit assembly 108) are essentially similar.

The circuit assembly 106 includes the input and output terminals 110, 112. The input and output terminals 110, 112 electrically connect to each other within the switch housing 102 through mating contacts 120 and 122. In the illustrated embodiment, the output terminal 112 may be referred to as a base terminal 112 since the output terminal remains generally fixed in position within the switch housing 102. The input terminal 110 may be referred to as a moveable terminal 110 since the input terminal 110 may be moved to and from the output terminal 112 during operation to connect and disconnect the movable terminal 110 with the base terminal 112. However, in other embodiments, the input terminal 110 may be a base terminal and the output terminal 112 may be a moveable terminal.

The base terminal 112 includes a stationary blade that is held within the switch housing 102 in a fixed position. The stationary blade extends through the switch housing 102 and is provided both inside and outside of the switch housing 102. The mating contact 122 is provided proximate to an end of the blade. The opposite end of the blade (e.g. the end of the blade outside of the switch housing 102) is turned downward, however such end may be turned upward or extend straight outward from the switch housing 102 in alternative embodiments. Another terminal may be electrically coupled to the end of the blade outside of the switch housing 102. For example, the downward part may be a separate terminal coupled to the base terminal 112. The movable terminal 110 and/or the base terminal 112 may be or include a post rather than or in addition to the stationary blade.

The movable terminal 110 includes a stationary blade that is held within the switch housing 102 in a fixed position. The stationary blade extends through the switch housing 102 and is provided both inside and outside of the switch housing 102. One or more spring blades or spring arms 124 are electrically coupled to an end of the blade. The spring arms 124 may be similar to the spring blades described in U.S. patent application Ser. No. 12/549,176, the subject matter of which is herein incorporated by reference in its entirety. The spring arms 124 may be stamped springs that are manufactured from a material that is conductive to allow current to flow between the blade of the base terminal 112 and the blade of the movable terminal 110. The spring arm 124 is sufficiently flexible to allow the spring arm 124 to move between the open and closed positions. The spring arms 124 are split and extend along bifurcated paths, which may increase the flexibility of the spring arms 124. Alternatively, a single spring arm 124 may be provided.

The mating contact 120 is provided proximate to an end of each spring arm 124 generally opposite the connection with the blade. The spring arm 124 is the movable part of the movable terminal 110. The spring arm 124 is movable between an open position and a closed position. In the closed position, the mating contact 120 is connected to, and engages, the mating contact 122 and current flows through the circuit assembly 106. In the open position, the mating contact 120 is disconnected from, and spaced apart from, the mating contact 122 such that current is unable to flow through the circuit assembly 106.

In the illustrated embodiment, the end of the stationary blade outside of the switch housing 102 is turned downward, however such end may be turned upward or extend straight outward from the switch housing 102. Another terminal may be electrically coupled to the end of the stationary blade outside of the switch housing 102. For example, the downward part may be a separate terminal coupled to the movable terminal 110. The movable terminal 114 and/or the base terminal 116 may be or include a post rather than or in addition to the stationary blade.

In an exemplary embodiment, the circuit assembly 106 is provided on the left-hand side of the switching housing 102, while the circuit assembly 108 is provided on the right-hand side of the switching housing 102. A spacing 126 is defined between the circuit assemblies 106, 108. In an exemplary embodiment, the input and output terminals 110, 112 are generally parallel to one another. The spring arms 124 are positioned between the blades of the input and output terminals 110, 112 and are generally parallel to the blades of the input and output terminals 110, 112. The spring arm 124 is arranged side-by-side with the stationary blade of the movable terminal 110 allowing current therein to create opposing forces to hold the spring arm 124 in the closed state, such as to resist blow out during high load or a short circuit fault event. The input and output terminals 114, 116 are generally parallel to one another. The input and output terminals 110, 112 are generally parallel to the input and output terminals 114, 116, with the spacing 126 defined therebetween.

The switching device 100 is configured to selectively control the flow of current through the switch housing 102. Current enters the switch housing 102 through the input terminals 110, 114 and exits the switch housing 102 through the output terminals 112, 116. In an exemplary embodiment, the switching device 100 is configured to simultaneously connect or disconnect the terminals 110, 112 and the terminals 114, 116. The switching device 100 includes an actuator assembly 130 that simultaneously connects or disconnects the terminals 110, 112 and the terminals 114, 116. The actuator assembly 130 is provided in the spacing 126 between the circuit assemblies 106, 108.

The actuator assembly 130 includes an electromechanical motor 132, a pivot member 134 operated by the motor 132, an actuator 136 moved by the pivot member 134, and compression springs 138 disposed between the actuator 136 and the pivot member 134. A pivot stabilizer 140 is held by the switch housing 102 and holds the pivot member 134 within the switch housing 102. The pivot member 134 is rotatable within the switch housing 102 between a first rotated position and a second rotated position. The motor 132 controls the position of the pivot member 134, such as by changing a polarity of a magnetic field generated by the motor 132.

The actuator 136 is slidable in a linear direction within the switch housing 102 between a first position and a second position, such as in the direction or arrow A. The pivot member 134 controls the position of the actuator 136. For example, the first rotated position may correspond with the first position of the actuator 136. The second rotated position may correspond with the second position of the actuator 136. The actuator 136 is coupled to the spring arms 124, as well as to spring arms 142 of the input terminal 114, for moving the spring arms 124, 142 between opened and closed positions to connect or disconnect the terminals 110, 112 and the terminals 114, 116.

The compression springs 138 provide a predetermined contact force on the spring arms 124, 142 to ensure the terminals 110, 112 and the terminals 114, 116 remain closed when the actuator 136 is in the second position. The compression springs 138 provide desired overtravel on the spring arms 124, 142. The compression springs 138 define overtravel springs that allow the actuator 136 to blow back in case of a short circuit fault condition. The compression springs 138 may be stock compression springs selected to have a predetermined size and/or spring force, depending on the holding force needed to maintain contact force on the spring arms 124, 142. Such springs may be obtained or manufactured inexpensively. A single compression spring 138 may be used rather than the two compression springs 138 illustrated in FIG. 2, making for a small number of parts and making assembly easier and less expensive. The compression springs 138 provide predictable, repeatable contact force on the spring arms 124, 142. In the illustrated embodiment, the compression springs 138 are coil springs, however other types of springs may be used in alternative embodiments. The compression springs 138 act on the actuator 136 rather than directly onto the spring arms 124, 142. The compression springs 138 do not need to be connected to the spring arms 124, 142 as the compression springs 138 exert spring force onto the spring arms 124, 142 via the actuator 136. This eliminates die tooling, staking and assembly, making the switching device 100 cost effective.

In some embodiments, the switching device 100 is communicatively coupled to a remote controller (not shown). The remote controller may communicate instructions to the switching device 100. The instructions may include operating commands for activating or inactivating the motor 132. In addition, the instructions may include requests for data regarding usage or a status of the switching device 100 or usage of electricity.

Figure 3:
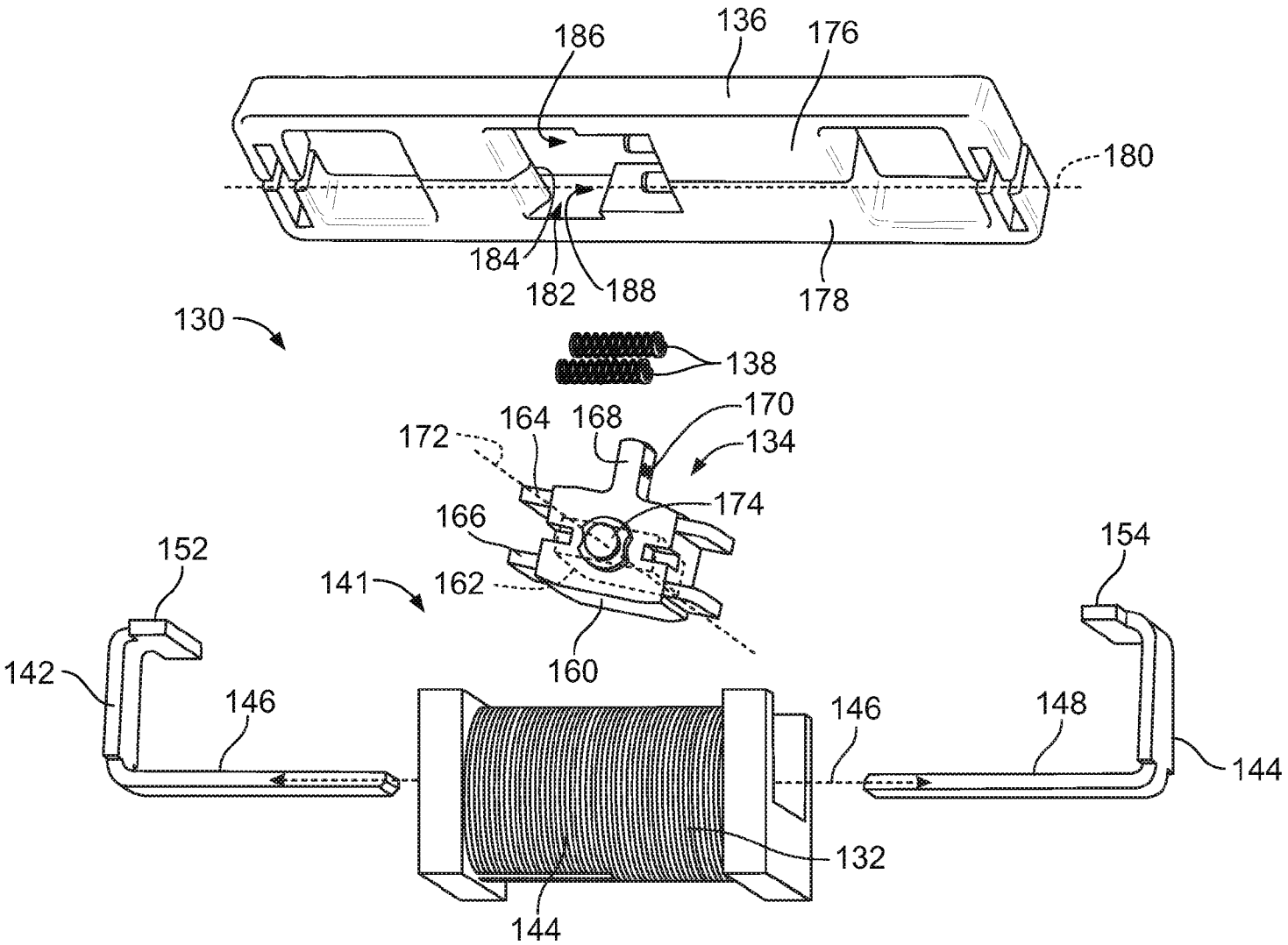
FIG. 3 is an exploded view of an actuator assembly for the electrical switching device shown in FIG. 1.

FIG. 3 is an exploded view of the actuator assembly 130. In the exemplary embodiment, the motor 132 generates a predetermined magnetic flux or field to control the movement of the pivot member 134 and the actuator 136. For example, the motor 132 may be a solenoid actuator. The motor 132 includes a drive coil 144 and a pair of yokes 146, 148. The yokes 146, 148 are configured to magnetically couple to the pivot member 134 to control rotation of the pivot member 134. When the drive coil 144 is activated, a magnetic field is generated and the pivot member 134 is arranged within the magnetic field. A direction of the field is dependent upon the direction of the current flowing through the drive coil 144. Based upon the direction of the current, the pivot member 134 will move to one of two rotational positions.

The pivot member 134 includes a pivot body 160 that holds a permanent magnet 162 (shown in phantom) and a pair of armatures 164 and 166. The magnet 162 has opposite North and South poles or ends that are each positioned proximate to a corresponding armature 166, 164. The armatures 164 and 166 may be positioned with respect to each other and the magnet 162 to form a predetermined magnetic flux for selectively rotating the pivot member 134. In the illustrated embodiment, the arrangement of the armatures 164 and 166 and the magnet 162 is substantially H-shaped. However, other arrangements of the armatures 164 and 166 and the magnet 162 may be made.

A projection or post 168 projects away from an exterior surface of the pivot body 160. In an exemplary embodiment, the post 168 includes a plurality of post pockets 170. The post pockets 170 are configured to receive ends of the compression springs 138. The post pockets 170 hold the compression springs 138 so that the compression springs 138 do not slide along the surface of the post 168. In an alternative embodiment, the post may include pegs (not shown) extending from the side of the post 168, where the compression springs 138 fit over the pegs.

The pivot member 134 rotates about a pivot axis 172 that extends through the center of rotation C. A cap 174 is provided at the top of the pivot member 134 and the pivot axis 172 extends through the cap 174. The cap 174 is configured to be received in the pivot stabilizer 140 (shown in FIG. 2).

The actuator 136 includes an upper actuator 176 and a lower actuator 178 that are stacked together to form the actuator 136. The upper and lower actuators 176, 178 are independently movable with respect to one another. Optionally, the upper and lower actuators 176, 178 may be identical to one another. Alternatively, the upper and lower actuators 176, 178 may be different than one another. The actuator 136 extends along a longitudinal axis 180. The actuator 136 is split into the upper and lower actuators 176, 178 along the longitudinal axis 180.

The actuator 136 includes an opening 182 therein. The post 168 is configured to be received in the opening 182. The actuator 136 includes a base wall 184 at one side of the opening 182. The post 168 rests along the base wall 184. The post 168 may press against the base wall 184 to move the actuator 136 when the pivot member 134 is rotated (e.g. in the counter-clockwise direction in the orientation illustrated in FIG. 3).

The upper actuator 176 includes a pocket 186 that opens to the opening 182. The pocket 186 receives one of the compression springs 138. The lower actuator 176 includes a pocket 188 that opens to the opening 182. The pocket 188 receives one of the compression springs 138. In the illustrated embodiment, the pockets 186, 188 are recessed within the bodies of the upper and lower actuators 176, 178. Alternatively, the pockets may be defined outside of the bodies of the upper and lower actuators 176, 178, such as along the side of the upper and lower actuators 176, 178. Optionally, portions of the upper and lower actuators 176, 178 may extend from the side to define the pockets 186, 188.

Figure 4:
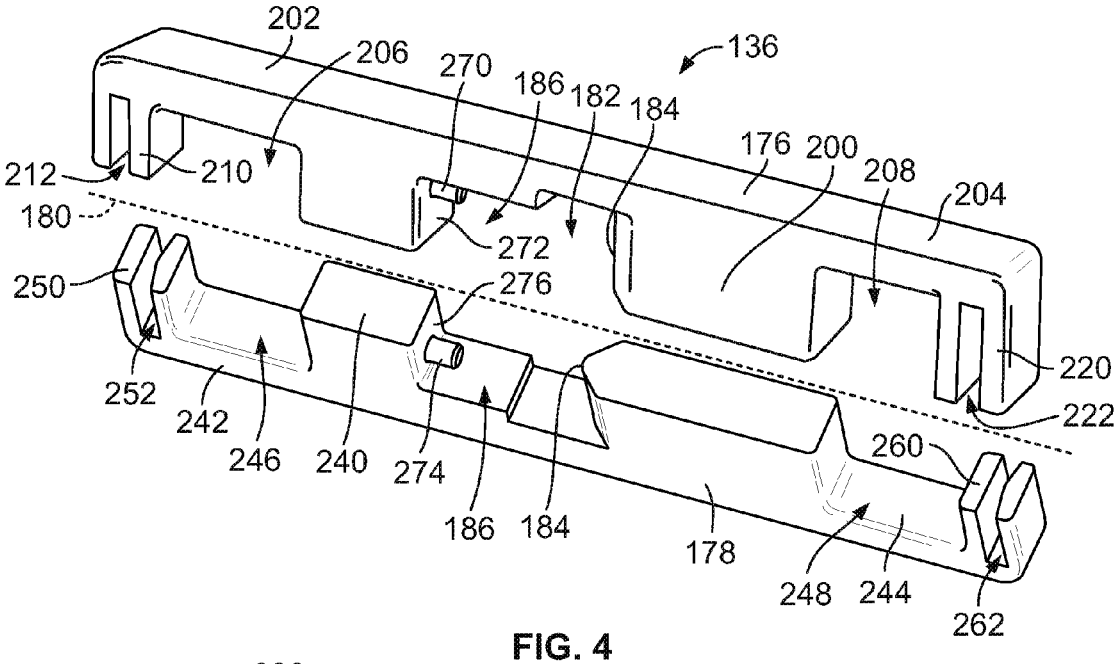
FIG. 4 is an exploded view of an actuator for the actuator assembly shown in FIG. 3.

FIG. 4 is an exploded view of the actuator 136, showing the upper actuator 176 and the lower actuator 178. In the illustrated embodiment, the upper actuator 176 and the lower actuator 178 are identical to one another. The lower actuator 178 is flipped 180° with respect to the upper actuator 176. The base wall 184 is angled to accommodate rotation of the pivot member 134 (shown in FIG. 2) within the opening 182.

The upper actuator 176 includes a main body 200 extending along the longitudinal axis 180. The opening 182 and the pocket 186 are provided in the main body 200. The upper actuator 176 includes a first arm 202 extending from the main body 200 in a first direction and a second arm 204 extending from the main body 200 in a second direction opposite to the first direction.

The first and second arms 202, 204 extend over corresponding channels 206, 208. The channels 206, 208 are configured to receive portions of the switch housing 102 (shown in FIG. 2) and/or portions of the circuit assemblies 106, 108 (shown in FIG. 2).

The first arm 202 includes fingers 210 extending downward therefrom at a distal end of the first arm 202. A slot 212 is defined between the fingers 210. The slot 212 receives the spring arm 124 (shown in FIG. 2). The spring arm 124 is captured between the fingers 210 within the slot 212. As the upper actuator 176 is moved between the first position and the second position, one or the other finger 210 engages the spring arm 124 to move the spring arm 124 between the open and closed positions. The slot 212 is oriented generally perpendicular to the longitudinal axis 180.

The second arm 204 includes fingers 220 extending downward therefrom at a distal end of the second arm 204. A slot 222 is defined between the fingers 220. The slot 222 receives the spring arm 142 (shown in FIG. 2). The spring arm 142 is captured between the fingers 220 within the slot 222. As the upper actuator 176 is moved between the first position and the second position, one or the other finger 220 engages the spring arm 124 to move the spring arm 124 between the open and closed positions. The slot 222 is oriented generally perpendicular to the longitudinal axis 180.

The lower actuator 178 includes a main body 240 extending along the longitudinal axis 180. The opening 182 and the pocket 186 are provided in the main body 240. The lower actuator 178 includes a first arm 242 extending from the main body 240 in a first direction and a second arm 244 extending from the main body 240 in a second direction opposite to the first direction.

The first and second arms 242, 244 extend over corresponding channels 246, 248. The channels 246, 248 are configured to receive portions of the switch housing 102 (shown in FIG. 2) and/or portions of the circuit assemblies 106, 108 (shown in FIG. 2). The channels 246, 248 are aligned with the channels 206, 208 of the upper actuator 176.

The first arm 242 includes fingers 250 extending upward therefrom at a distal end of the first arm 242. A slot 252 is defined between the fingers 250. The fingers 250 and slot 252 are aligned with the fingers 210 and slot 212 of the upper actuator 176. The slot 252 receives the spring arm 124 (shown in FIG. 2). The spring arm 124 is captured between the fingers 250 within the slot 252. As the lower actuator 178 is moved between the first position and the second position, one or the other finger 250 engages the spring arm 124 to move the spring arm 124 between the open and closed positions. The slot 252 is oriented generally perpendicular to the longitudinal axis 180.

The second arm 244 includes fingers 260 extending downward therefrom at a distal end of the second arm 244. A slot 262 is defined between the fingers 260. The fingers 260 and slot 262 are aligned with the fingers 220 and slot 222 of the upper actuator 176. The slot 262 receives the spring arm 142 (shown in FIG. 2). The spring arm 142 is captured between the fingers 260 within the slot 262. As the lower actuator 178 is moved between the first position and the second position, one or the other finger 260 engages the spring arm 124 to move the spring arm 124 between the open and closed positions. The slot 262 is oriented generally perpendicular to the longitudinal axis 180.

The upper actuator 176 includes a peg 270 extending from a wall 272 opposite the base wall 184. The lower actuator 178 includes a peg 274 extending from a wall 276 opposite the base wall 184. The pegs 270, 274 extend into the pockets 186, 188. The compression springs 138 (shown in FIG. 2) are received on the pegs 270, 274 to hold the compression springs 138 within the pockets 186, 188.

Figure 5:
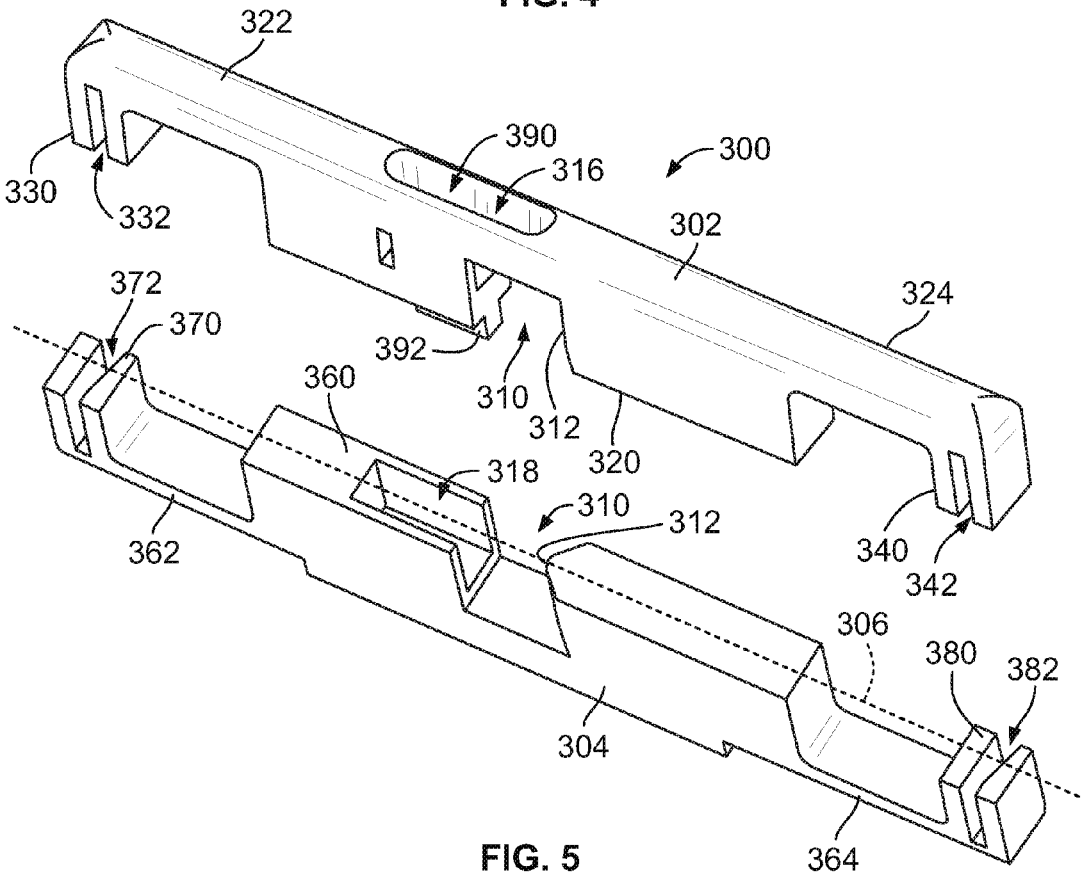
FIG. 5 is an exploded view of an alternative actuator for the actuator assembly shown in FIG. 3.

FIG. 5 is an exploded view of an alternative actuator 300 that may be used in place of the actuator 136 (shown in FIG. 3). The actuator 300 includes an upper actuator 302 and a lower actuator 304 that are stacked together to form the actuator 300. The upper and lower actuators 302, 304 are independently movable with respect to one another. The upper and lower actuators 302, 304 are different than one another. The actuator 300 extends along a longitudinal axis 306.

The actuator 300 includes an opening 310 therein, defined by corresponding opening portions in the upper and lower actuators 302, 304. When the upper and lower actuators 302, 304 are assembled, the opening portions are aligned to form the opening 310. The post 168 (shown in FIG. 3) is configured to be received in the opening 310. The actuator 300 includes a base wall 312 at one side of the opening 310, defined by corresponding base wall portions in the upper and lower actuators 302, 304. When the upper and lower actuators 302, 304 are assembled, the base wall portions are aligned to form the base wall 312.

The upper actuator 302 includes a pocket 316 that opens to the opening 310. The pocket 316 receives one of the compression springs 138 (shown in FIG. 3). The lower actuator 302 includes a pocket 318 that opens to the opening 310. The pocket 318 receives one of the compression springs 138. In the illustrated embodiment, the pockets 316, 318 are recessed within the bodies of the upper and lower actuators 302, 304. Alternatively, the pockets may be defined outside of the bodies of the upper and lower actuators 302, 304, such as along the side of the upper and lower actuators 302, 304. Optionally, portions of the upper and lower actuators 302, 304 may extend from the side to define the pockets 316, 318.

The upper actuator 302 includes a main body 320 extending along the longitudinal axis 306. The opening 310 and the pocket 316 are provided in the main body 320. The upper actuator 302 includes a first arm 322 extending from the main body 320 in a first direction and a second arm 324 extending from the main body 320 in a second direction opposite to the first direction.

The first arm 322 includes fingers 330 extending downward therefrom at a distal end of the first arm 322. A slot 332 is defined between the fingers 330. The slot 332 receives the spring arm 124 (shown in FIG. 2). The spring arm 124 is captured between the fingers 330 within the slot 332. As the upper actuator 302 is moved between the first position and the second position, one or the other finger 330 engages the spring arm 124 to move the spring arm 124 between the open and closed positions. The slot 332 is oriented generally perpendicular to the longitudinal axis 306.

The second arm 324 includes fingers 340 extending downward therefrom at a distal end of the second arm 324. A slot 342 is defined between the fingers 340. The slot 342 receives the spring arm 142 (shown in FIG. 2). The spring arm 142 is captured between the fingers 340 within the slot 342. As the upper actuator 302 is moved between the first position and the second position, one or the other finger 340 engages the spring arm 124 to move the spring arm 124 between the open and closed positions. The slot 342 is oriented generally perpendicular to the longitudinal axis 180.

The lower actuator 304 includes a main body 360 extending along the longitudinal axis 306. The opening 310 and the pocket 316 are provided in the main body 360. The lower actuator 304 includes a first arm 362 extending from the main body 360 in a first direction and a second arm 364 extending from the main body 360 in a second direction opposite to the first direction.

The first arm 362 includes fingers 370 extending downward therefrom at a distal end of the first arm 362. A slot 372 is defined between the fingers 370. The fingers 370 and slot 372 are aligned with the fingers 330 and slot 332 of the upper actuator 302. The slot 372 receives the spring arm 124 (shown in FIG. 2). The spring arm 124 is captured between the fingers 370 within the slot 372. As the lower actuator 304 is moved between the first position and the second position, one or the other finger 370 engages the spring arm 124 to move the spring arm 124 between the open and closed positions. The slot 372 is oriented generally perpendicular to the longitudinal axis 306.

The second arm 364 includes fingers 380 extending downward therefrom at a distal end of the second arm 364. A slot 382 is defined between the fingers 380. The fingers 380 and slot 382 are aligned with the fingers 340 and slot 342 of the upper actuator 302. The slot 382 receives the spring arm 142 (shown in FIG. 2). The spring arm 142 is captured between the fingers 380 within the slot 382. As the lower actuator 304 is moved between the first position and the second position, one or the other finger 380 engages the spring arm 124 to move the spring arm 124 between the open and closed positions. The slot 382 is oriented generally perpendicular to the longitudinal axis 306.

The upper actuator 302 includes a window 390 that provides access to the pocket 316. The compression spring 138 may be loaded into the pocket 316 through the window 390. The upper actuator 302 includes a projection 392 extending downward from the main body 320. When assembled, the projection 392 is received in the pocket 318 of the lower actuator 178. The projection 392 is slidable within the pocket 318 to allow relative movement between the upper actuator 302 and the lower actuator 304. The projection 392 guides the movement of the upper actuator 302 with respect to the lower actuator 178.

Figure 6:
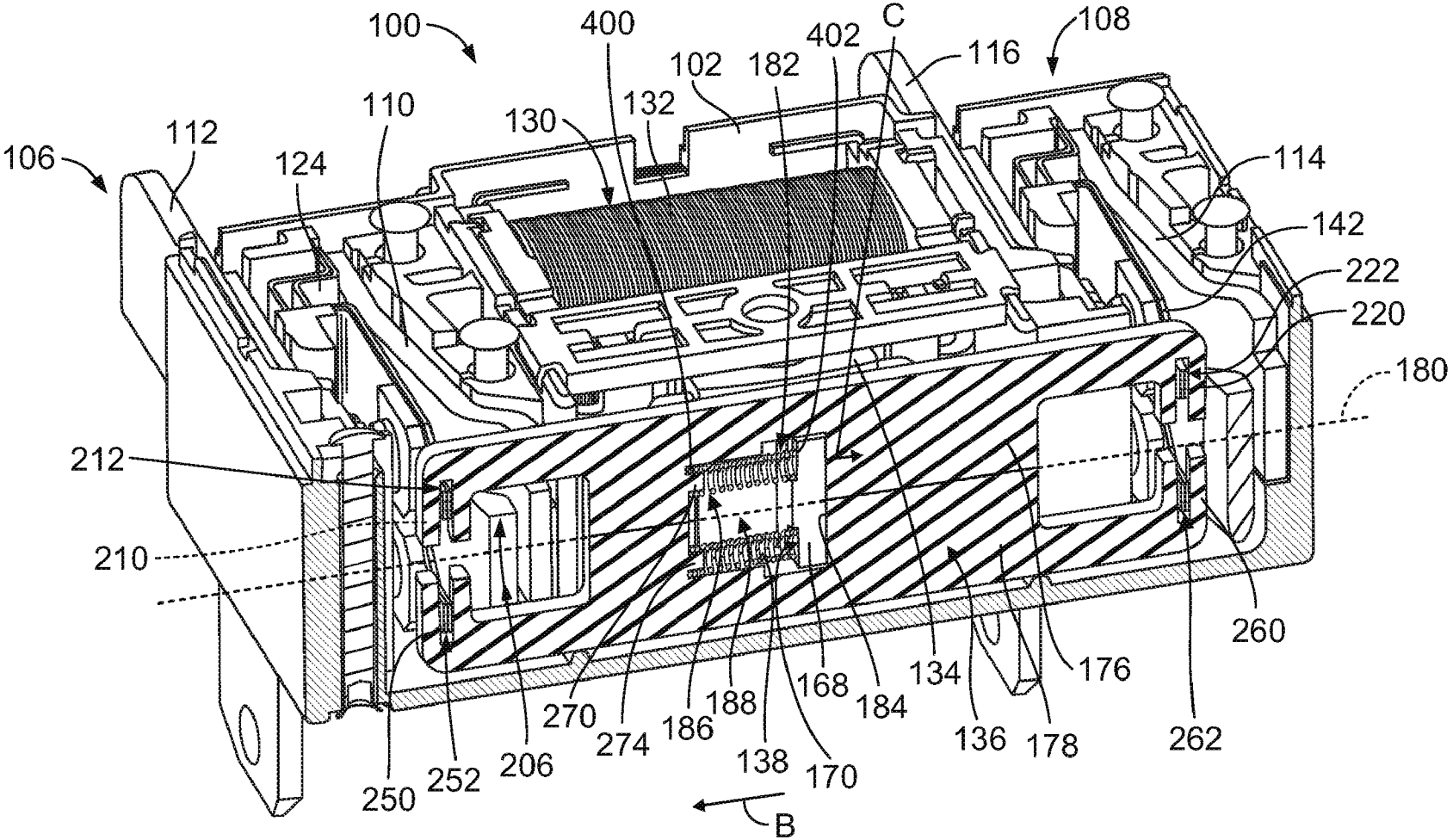
FIG. 6 is a partial sectional view of a portion of the electrical switching device.

FIG. 6 is a partial sectional view of a portion of the electrical switching device 100. The switch housing 102 has been removed illustrating portions of the circuit assemblies 106, 108 as well as the actuator assembly 130. Portions of the actuator assembly 130 are cut away. For example, the upper and lower actuators 176, 178 are cut away. The post 168 is cut away. The compression springs 138 are cut away.

When assembled, the spring arms 124 are received in the slots 212, 252 and the spring arms 142 are received in the slots 222, 262. The upper actuator 176 engages and actuates two spring arms 124, 142, and the lower actuator 178 engages and actuates two spring arms 124, 142. The upper and lower actuators 176, 178 are biased using just two compression springs 138, thus each compression spring 138 exerts spring force on two spring arms 124, 142. A separate compression spring is not need for each spring arm 124, 142, thus reducing the total number of parts and assembly time.

When assembled, the post 168 is received in the opening 182 against the base wall 184. The compression springs 138 are received in the pockets 186, 188 and are held by the pegs 270, 274. The compression springs 138 are also received in the post pockets 170 to hold the compression springs 138 in position with respect to the post 168. The compression springs 138 extend between a first end 400 and a second end 402. The first end 400 engages the actuator 136. The second end 402 engages the post 168. The second end 352 is received in a corresponding post pocket 170.

The compression springs 138 generally extend along the longitudinal axis 180. The compression springs 138 provide a force against the actuator 136 to push on the movable terminals 110, 114 toward the base terminals 112, 116. For example, the spring arms 124 are received in corresponding slots 212, 232. The compression springs 138 force the upper and lower actuators 176, 178 in the direction of arrow B, which presses the fingers 210 against the spring arms 124. The direction of the force is parallel to the direction of movement of the actuator 136. The fingers 210 hold the spring arms 124 in the closed state.

During use, in a short circuit fault situation, the compression springs 138 allow the movable terminals 110, 114 to disconnect from the base terminals 112, 116. The compression springs 138 may be compressed, allowing the actuator 136 to move toward the first position.

A portion of the movable terminal 110 extends through the channels 206, 246. The channels 206, 246 are wide enough to accommodate of movement of the actuator 136 with respect to the terminal 110.

In the illustrated embodiment, the actuator assembly 130 is in a closed state in which the movable terminals 110, 114 are connected to the base terminals 112, 116, respectively. The spring arms 124 engage the base terminal 112. The spring arms 142 engage the base terminal 116. The pivot member 134 is in the second rotational position, which forces the actuator 136 to the second position.

The actuator assembly 130 may be moved to an open position by operating the drive coil 144 to rotate the pivot member 134 to the first rotational position. As the pivot member 134 is moved to the first rotational position, the post 168 engages the base wall 184 and the pivot member 134 pushes the actuator 136 in the direction of arrow C to the first position. As the actuator 136 is moved in the direction of arrow C, the fingers 210 engage the spring arms 124 and move the spring arms 124 away from the base terminal 112. Similarly, the fingers 250 engage the spring arms 142 and move the spring arms 142 away from the base terminal 116. The circuits are opened when the spring arms 124, 142 are disconnected from the base terminals 112, 116.

Furthermore, the above-described embodiments (and/or aspects thereof) may be used in combination with each other. In addition, many modifications may be made to adapt a particular situation or material to the teachings of the invention without departing from its scope. While the specific components and processes described herein are intended to define the parameters of the various embodiments of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical switching device comprising:

first and second circuit assemblies, each of the first and second circuit assemblies comprising a base terminal and a moveable terminal movable between an open state and a closed state, the movable terminal being electrically connected to the base terminal in the closed state; and an actuator assembly being electromechanically controlled by a motor, the actuator assembly comprising:

a pivot member rotated by the motor, the pivot member having a post extending outward from a pivot body;

an actuator moved by the pivot, the actuator being movable between a first position and a second position, the actuator being operatively coupled to the moveable terminals of the first and second circuit assemblies, the actuator moving the movable terminals to the closed state as the actuator is moved from the first position to the second position, the actuator having a pocket; and a compression spring received in the pocket, the compression spring extending between a first end and a second end, the first end engaging the actuator, the second end engaging the post, the compression spring providing a force on the actuator to push the movable terminals toward the base terminals wherein the actuator extends along a longitudinal axis, the actuator being split along the longitudinal axis into an upper actuator and a lower actuator independently movable with respect to one another.

2. The switching device of claim 1, wherein the actuator extends along a longitudinal axis, the compression spring extending along the longitudinal axis and imparting a spring force in a direction parallel to the longitudinal axis.

3. The switching device of claim 1, wherein the actuator includes a main body, the post extending into the main body, the actuator including a first arm extending from the main body in a first direction and a second arm extending from the main body in a second direction, the first and second arms including fingers engaging corresponding movable terminals.

4. The switching device of claim 1, wherein the actuator includes a main body extending along a longitudinal axis, the main body including an opening therethrough having a base wall at one of the opening, the pocket being open to the opening, the post extending into the opening and engaging the base wall, the pivot member being rotated in a first rotational direction and a second rotational direction, the post engaging the base wall as the pivot member is moved in the first rotational direction to move the actuator to the first position, the post pushing the compression spring into the actuator to move the actuator to the second position as the pivot member is moved in the second rotational direction.

5. The switching device of claim 1, wherein the electrical switching device includes a housing holding the first and second circuit assemblies and the actuator assembly, the base terminals and the movable terminals of the first circuit assembly being provided proximate to a first end of the housing, the base terminals and mounting terminals of the second circuit assembly being provided proximate to a second end of the housing.

6. The switching device of claim 1, wherein the motor includes a solenoid actuator having a drive coil, the pivot member having a permanent magnet being movable based on operation of the drive coil to rotate the pivot.

7. The switching device of claim 1, wherein, the compression spring being received in the upper actuator, and the electrical switching device further comprising a second compression spring received in the lower actuator.

8. The switching device of claim 1, wherein, the upper actuator including a projection extending therefrom, and the projection being received in the lower actuator to guide movement of the upper actuator with respect to the lower actuator along the longitudinal axis.

9. The switching device of claim 1, wherein the movable terminals extend substantially parallel to each other and have a spacing therebetween, the actuator extending lengthwise across the spacing, the pivot member being located within the spacing between the movable terminals.

10. The switching device of claim 1, further comprising a housing, the base terminals and the movable terminals of the first and second circuit assemblies extending substantially parallel to one another within the housing, the motor and the pivot member being located between the first and second circuit assemblies within the housing.

11. An electrical switching device comprising:

first and second circuit assemblies, each of the first and second circuit assemblies comprising a base terminal and a moveable terminal movable between an open state and a closed state, the movable terminal being electrically connected to the base terminal in the closed state; and an actuator assembly being electromechanically controlled by a motor, the actuator assembly comprising:

a pivot member rotated by the motor, the pivot member having a post extending outward from a pivot body;

an actuator moved by the pivot member between a first position and a second position, the actuator being operatively coupled to the moveable terminals of the first and second circuit assemblies, the actuator extending along a longitudinal axis, the actuator being split along the longitudinal axis into an upper actuator and a lower actuator independently movable with respect to one another; and first and second compression springs, the first compression spring extending between the post and the upper actuator, the second compression spring extending between the post and the lower actuator, the first and second compression springs providing forces on the upper and lower actuators to push the movable terminals toward the base terminals.

12. The switching device of claim 11, wherein the compression spring extends along the longitudinal axis and imparts a spring force in a direction parallel to the longitudinal axis.

13. The switching device of claim 11, wherein the actuator includes a main body, the post extending into the main body, the actuator including a first arm extending from the main body in a first direction and a second arm extending from the main body in a second direction, the first and second arms including fingers engaging corresponding movable terminals.

14. The switching device of claim 11, wherein the actuator includes a main body extending along a longitudinal axis, the main body including an opening therethrough having a base wall at one of the opening, the pocket being open to the opening, the post extending into the opening and engaging the base wall, the pivot member being rotated in a first rotational direction and a second rotational direction, the post engaging the base wall as the pivot member is moved in the first rotational direction to move the actuator to the first position, the post pushing the compression spring into the actuator to move the actuator to the second position as the pivot member is moved in the second rotational direction.

15. The switching device of claim 11, wherein the electrical switching device includes a housing holding the first and second circuit assemblies and the actuator assembly, the base terminals and the movable terminals of the first circuit assembly being provided proximate to a first end of the housing, the base terminals and mounting terminals of the second circuit assembly being provided proximate to a second end of the housing.

16. The switching device of claim 11, wherein the movable terminals extend substantially parallel to each other and have a spacing therebetween, the actuator extending lengthwise across the spacing, the pivot member being located within the spacing between the movable terminals.

* * * * *